US005617689A

United States Patent [19]

Beane

[11] Patent Number: 5,617,689

[45] Date of Patent: Apr. 8, 1997

[54] SYSTEM FOR ASSEMBLING DECK STRUCTURES

[76] Inventor: Douglas J. Beane, 1062 S. Yachtsman Dr., Sanibel, Fla. 33957

[21] Appl. No.: 501,549

[22] Filed: Jul. 12, 1995

[51] Int. Cl.[6] ..... E04B 5/00

[52] U.S. Cl. ..... 52/489.1; 52/177; 52/474; 52/506.08; 52/299

[58] Field of Search ..... 108/561; 52/474, 52/489.1, 177, 299, 506.08, 506.09, 506.07

[56] References Cited

U.S. PATENT DOCUMENTS

| | | | |
|---|---|---|---|
| 3,999,346 | 12/1976 | Fetherson | 52/474 |
| 4,145,976 | 3/1979 | Svirklys | 108/56.1 |
| 4,313,688 | 2/1982 | Daniels | 52/299 X |
| 4,947,595 | 8/1990 | Douds et al. | 52/177 |
| 5,009,045 | 4/1991 | Yoder | 52/177 |
| 5,048,448 | 9/1991 | Yoder | 52/588 X |
| 5,059,253 | 9/1991 | Bedics | 52/177 |
| 5,152,114 | 10/1992 | Beazley et al. | 52/299 X |
| 5,263,288 | 11/1993 | Yang | 52/489.1 X |
| 5,263,295 | 10/1992 | Laird et al. | 52/506.08 |

*Primary Examiner*—Wynn E. Wood
*Attorney, Agent, or Firm*—William E. Noonan

[57] ABSTRACT

A system is disclosed for assembling a deck structure. The system includes an elongate joist member having at least one inwardly facing slot. Each slot has an interior portion and an entrance that is narrower than the interior portion. A mounting bracket has a first leg that engages the joist member and a second leg that is attached to and extends at an angle from the first leg for engaging a section of the deck structure. The bracket is connected to the joist member by at least one primary connector element that is retained by and extends from a respective slot and engages a corresponding opening in the first leg of the bracket. There is at least one secondary connector. Each secondary connector element is engaged with a corresponding primary connector element to restrict the bracket from disengaging the corresponding primary connector element. A mounting bar for plank retaining clips may be mounted to a stringer, a joist member or some other part of the deck frame.

20 Claims, 7 Drawing Sheets

SYSTEM FOR ASSEMBLING DECK STRUCTURES

FIELD OF THE INVENTION

This invention relates to an improved system for constructing deck-like structures, and more particularly, to a metallic frame, mounting bar and additional hardware for supporting a plurality of preferably extruded deck planks.

BACKGROUND OF THE INVENTION

Outdoor decks, boat docks and similar systems traditionally are constructed of wood. Because such structures are exposed to the elements, they require considerable maintenance. Elements that make up conventional deck systems, including joists, stringers and planks, tend to deteriorate over time and must be repaired or replaced on a fairly regular basis. Pressure treating or applying preservatives to the lumber used in the deck can prolong the life of the structure. However, increasingly strict environmental regulations will likely limit the use of pressure treating and chemical preservatives in the future.

Welded decks are also known. However, these structures must be custom manufactured and typically do not utilize mass produced or standard sized parts. As a result, the time and expense required to manufacture such decks are considerable.

Recently, decking systems have been introduced that employ extruded plastic planks. U.S. Pat. No. 5,048,448 discloses a clip apparatus that is used to mount such planks to a wooden frame. Although such systems are easier to maintain than conventional all-wood decks, they still exhibit a number of disadvantages. Because wood continues to be used for the frame, regular maintenance of the frame is still required. Additionally, installing the mounting clips on the frame is labor intensive. Presently, each clip has to be individually screwed or otherwise secured to the underlying structural frame.

SUMMARY OF INVENTION

It is therefore an object of the present invention to provide an improved deck assembly that has a significantly longer life and requires much less maintenance than deck systems of the prior art.

It is a further object of this invention to provide a system that permits a deck to be constructed quickly, conveniently and inexpensively using mass produced, modular parts.

It is a further object of this invention to provide a light weight, yet extremely strong and durable deck assembly that may be utilized for a wide variety of deck applications, including outdoor porches, boat dock, etc.

It is therefore an object of the present invention to provide a deck assembly that is highly resistant to deterioration normally caused by weather, water and other outdoor elements.

It is a further object of this invention to provide a system for constructing a deck assembly that is extremely versatile and it permits the construction of a variety of deck configurations.

It is a further object of this invention to provide, as part of an overall improved deck assembly, a mounting bar that supports a plurality of standard plank retaining clips so that they do not have to be individually secured to the deck frame.

It is a further object of this invention to provide a system for deck assembly that permits standard deck planks to be mounted much more quickly and conveniently to the underlying frame than has previously been possible.

This invention results from a realization that an improved deck assembly may be achieved by utilizing a frame composed of aluminum or some other rust-proof metal or plastic. This invention results from the further realization that a deck assembly may be constructed much more quickly and conveniently by using mass produced, modular pieces featuring, in particular, a peripheral joist element having a pair of inwardly facing slots and an upper longitudinal channel, as well as a transverse stringer element, which includes an upper channel for receiving a snapfit mounting bar. The mounting bar permits a plurality of side by side plank retaining clips to be secured to the stringer as a group, rather than individually. This saves considerable labor and expense in the construction of the deck.

This invention features a system for assembling a deck structure. The system includes an elongate joist member having means defining at least one longitudinal, inwardly facing slot formed therein. Each slot has an interior portion and an entrance that is narrower than the interior portion. A mounting bracket has a first leg that engages the joist member and a second leg that is attached to and extends at an angle from the first leg for engaging a section of the dock structure. There are means for connecting, the bracket to the joist member, including at least one primary connector element. Each primary connector element is retained by and extends from a respective slot and engages a corresponding opening in the first leg of the bracket. There is also at least one secondary connector element. Each secondary connector element is engaged with a corresponding primary connector element to restrict the bracket from disengaging the corresponding primary connector element.

In a preferred embodiment, the joist member includes a pair of slots arranged parallel to one another. The means for connecting preferably include a pair of primary connector elements, each of which is associated with a respective one of the slots. In such cases, a pair of secondary connectors are provided, each of which is engaged with a respective one of the primary connector elements.

A plurality of elongate, interconnected joist members may define a peripheral frame. At least one elongate stringer may extend between a pair of the joist members. Each such stringer includes a pair of receptacles formed in respective ends thereof. One or more of the above-described brackets interconnect each end of each stringer to a respective joist member. In particular, each bracket includes a first leg that engages the respective joist member and a second leg that is attached angularly to and extends from the first leg and is received by the receptacle in the interconnected end of the stringer. Means, previously described, are provided for connecting, each bracket to the respective joist member. As a result, each stringer is mounted to a pair of joist members.

Preferably, the means for interconnecting each end of the stringer may include a pair of mounting brackets. The respective second legs of these mounting brackets comprise planar elements that extend generally parallel to one another. Each receptacle in the stringer may include a pair of separated compartments. Each compartment receives a second leg of a respective one of the pair of mounting brackets. The joist member may include at least one interior channel for accommodating a respective reinforcing element.

Each stringer may include a longitudinal channel. The system may further include an elongate mounting bar that is received in the channel. The channel and the bar may include complementary means for securely retaining the bar in the channel and a plurality of plank retaining clips may be mounted to the bar and arranged generally side by side thereon. Each clip element may have means for retaining a respective deck plank such that the plank extends transversely across the stringer. The complementary means may include a pair of detents carried respectively on a first side and an opposite second side of the stringer channel. Also, a pair of resilient legs may depend from an upper portion of the bar. Each such leg includes an indented portion that receives a respective one of the detents when the legs are introduced into the channel to securely retain the bar in the channel.

The primary connector element may include a bolt-like element having the head received in a respective slot and a threaded shaft that engages the corresponding opening. Each secondary connector element may include a nut-like element that threadably engages the shaft of a respective primary connector element.

At least one joist member may include a longitudinal upper channel for receiving a respective mounting bar. The pair of joist members interconnected by one or more stringers may have a longitudinal upper channel and a recess that interconnects the longitudinal upper channel with the longitudinal channel in the stringer interconnected to the joist member. As a result, the mounting bar received in the longitudinal stringer channel may extend through the recess and transversely through the upper channel in the joist member.

DETAILED DESCRIPTION OF PREFERRED EMBODIMENTS

Other objects, features and advantages will occur from the following description of preferred embodiments and the accompanying drawings, in which.

Figure 1:
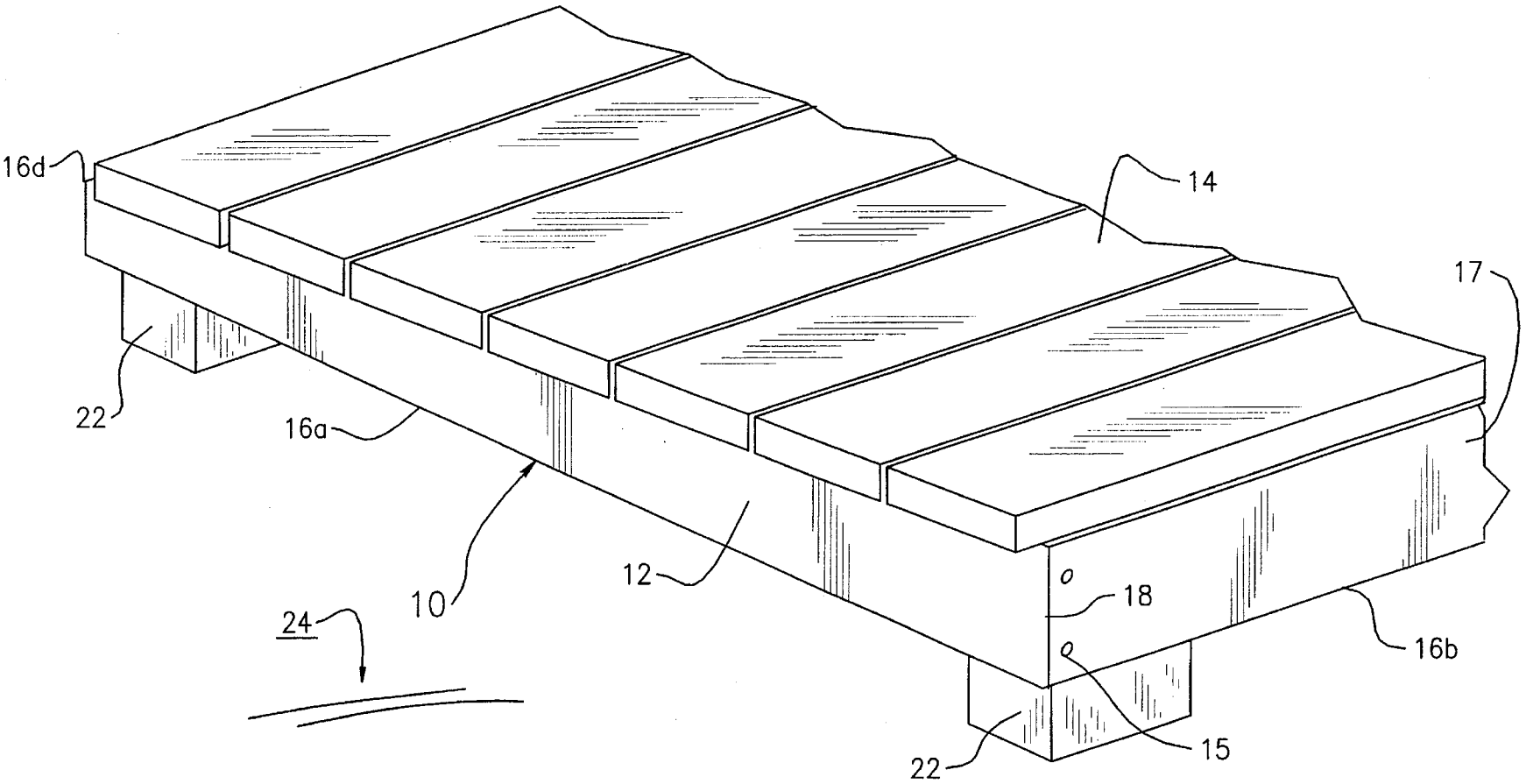
FIG. 1 is a perspective view of a deck structure that employs the system of this invention.

There is shown in FIG. 1, a deck assembly 10 manufactured according to this invention. Deck assembly 10 includes an aluminum frame 12 that supports a plurality of extruded plastic planks 14. The frame may alternatively comprise other rustproof metals or various plastics such as PVC. Frame 12 is itself supported by a plurality of posts 22 that are composed of wood, metal or a synthetic material. Posts 22 are set into ground 24 in a conventional manner.

Figure 2:
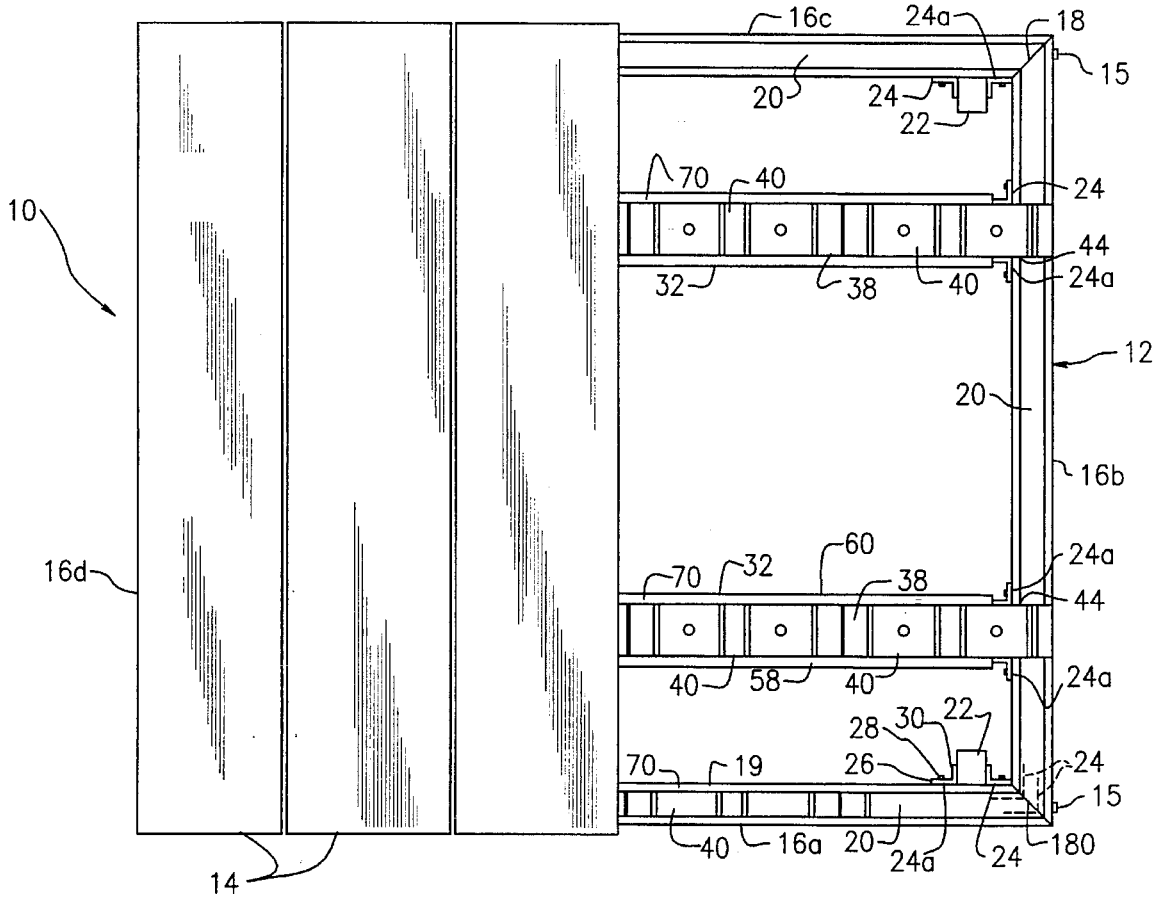
FIG. 2 is a plan view of a deck system using the system of this invention wherein a number of deck planks are removed to illustrate the various components of the system.

As best shown in FIG. 2, frame 12 has a generally rectangular peripheral shape and comprises rim joist members 16i a, 16*b*, 16*c* and 16*d* that are arranged in an end to end fashion. The joist members include mitered corners 18 and are secured together by bolts 15. A number of planks 14 are removed to clearly illustrate the components of frame 12. Although a rectangular peripheral shape is disclosed, in alternative embodiments, various non-rectangular configurations may be utilized. The frame also includes a pair of stringers 32 that extend between opposite, parallel joist members 16*b* and 16*d*. Stringers 32 are connected to joists 16*b* and 16*d* by L-shaped brackets 24, 24*a* (shown attached to joist member 16*b* only). The stringers 32 extend beneath the planks 14 and are connected thereto in a manner illustrated below. In alternative embodiments, various other numbers of stringers 32 may be utilized. The exact number is determined by the size and shape of deck assembly 10.

Figure 3:
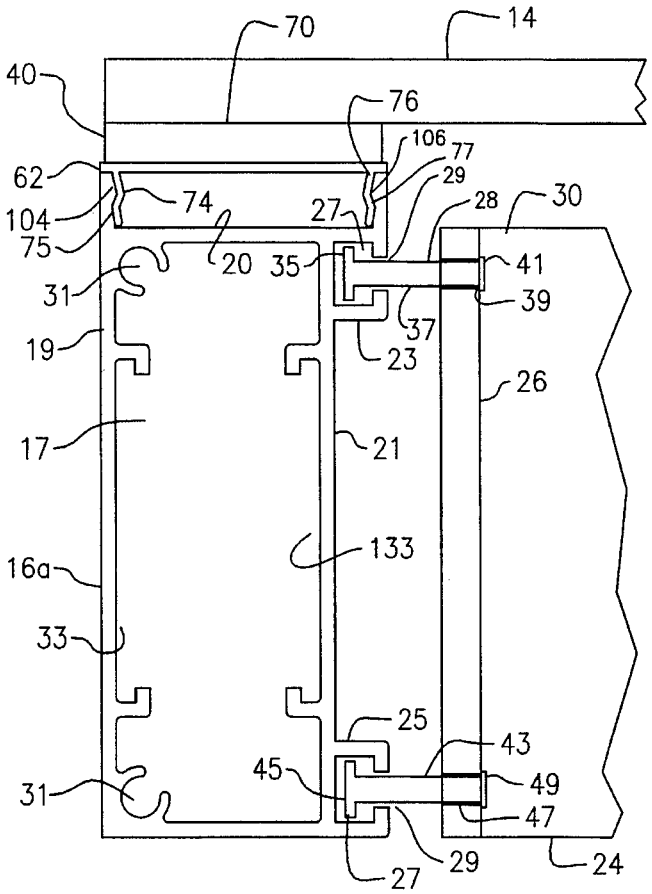
FIG. 3 is a cross sectional view of a representative joist member with a mounting bracket attached thereto.

A representative joist member 16*a* is depicted in FIG. 3. Each of the remaining joist members 16*b*–16*d* has a similar structure. In particular, joist member 16*a* has a generally rectangular cross sectional shape and comprises a hollow tube having an interior chamber 17. As is also shown in FIG. 1, the outside surface 19 of each joist member is substantially flat. Inwardly facing joist surface 21, FIG. 3, carries a pair of slotted sections 23 and 25, respectively, proximate upper and lower edges of the joist member. Each of the slotted sections 23 and 25 includes an interior portion 27 and an entrance 29 that is narrower than interior portion 27. A longitudinal channel 20, also shown in FIG. 2, is formed on the top surface of joist member 16*a* and on each of the other joist members. A pair of grooves 31 are formed in the upper and lower outward corners of interior chamber 17. Grooves 31 receive respective screws 15, FIGS. 1 and 2, inserted through openings in the outside surface adjacent joist member 16*b*. Each adjoining pair of joist members are connected securely together in this manner. Chamber 17 also includes a pair of interior channels 33 and 133 formed on opposite walls of the chamber. These channels communicate with corresponding interior channels on the adjoining joist member 16*b*. The communicating channels receive respective L-shaped brackets, which reinforce the peripheral frame. This construction is described more fully below.

A representative mounting bracket 24 (bracket 24*a* having a similar construction) is secured to the inwardly facing surface 21 of joist member 16*a*. A significant feature of assembly 10 is this L-shaped mounting bracket, which may be mounted at various locations along any of the rim joist members 16*a*–16*d*. Bracket 24 includes a first leg 26 that engages slots 23 and 25 of joist member 16*a*. In FIG. 3, leg 16 is shown spaced apart from the slotted sections for clarity. However, in use, the leg is actually in direct engagement with the slotted sections. A second leg 30 is secured unitarily to leg 26 and extends at an angle therefrom. In FIG. 3, the angle between legs 26 and 30 of plate 24 is 90°. However, as is described more fully below, this angle may vary depending upon the shape of frame 12.

Mounting bracket 24 again preferably comprises aluminum or some other lightweight, yet strong and rustproof, metal or metal alloy. Synthetic materials may also be utilized. Each of the legs 26 and 30 has a generally flat, platelike shape. Bracket 24 is secured to joist member 16*a* by a pair of connectors. In particular, a threaded primary connector element comprises a bolt 28 having a head 35 that is disposed within interior portion 27 of slot 23. Head 35 is larger than the width of slot entrance 29 so that bolt 28 is retained in slot 23 and extends therefrom. The threaded shaft 37 of bolt 28 extends through a complementary opening 39 in leg 26 of bracket 24. A secondary connector element, comprising a nut 41, is engaged with threaded shaft 37 in a conventional manner to secure bracket 24 to lower connector element 28. A similar primary connector element 43 has a head 45 that is retained within interior portion 27 of slot 25. Bolt 43 includes a threaded section 47 that extends through a complementary opening in leg 26 of bracket 24. A secondary connector, comprising a nut 49, secures to shaft 47 so that bracket 24 is also securely attached to lower bolt 47. This manner of attaching the bracket to the joist member applies to each mounting bracket described therein.

Various uses for the mounting brackets are shown in FIG. 2. For example, a complementary pair of generally L-shaped brackets 24 and 24*a* are mounted to joist member 16*a* such that they are disposed on either side of a respective post 22. The first leg sections 26 of the respective brackets 24, 24*a* extend in generally opposite directions along joist member 16*a*. Each of the brackets 24, 24*a* is secured to joist member 16*a* in the manner described above. The second leg sections 30 of the brackets extend parallel to one another from joist member 16*a* and are disposed on either side of post 22. The brackets are fastened to the post by bolts, screws or other connectors that are engaged with openings in the second legs 30 and with complementary openings in the sides of post 22. In a like manner, frame 12 is secured to and supported by a plurality of posts 22. In FIG. 2, one additional post is shown attached to joist member 16*c* by a pair of brackets 24, 24*a*.

When adjoining joist members, such as joist members 16*a* and 16*b* are interconnected, a pair of mounting brackets, constructed as described above, are inserted in the abutting interior chambers 17 (FIG. 3). A pair of such brackets 24*b* are shown in phantom in FIG. 2. The first leg 26 of one of the brackets is received in the interior channel 33 of joist member 16*a* and the other leg 30 of that bracket is received in the communicating channel 33 of adjacent joist member 16*b*. Similarly, the second bracket 24*b* includes a first leg 26 that is received in the interior chamber 133 of joist member 16*a*. The second leg 30 of the second bracket member is likewise received in the complementary interior chamber 133 of adjoining joist member 16*b*.

Figure 4:
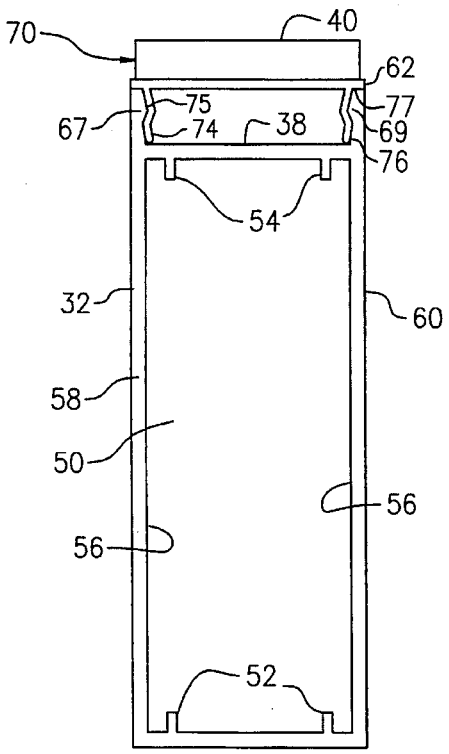
FIG. 4 is a cross sectional view of a representative stringer and an attached mounting bar and plank retaining clip.

Brackets 24, 24*a* are also employed to interconnect each end of each stringer 32 to a respective one of the joist members 16*b* and 16*d*. A representative stringer 32 is depicted in FIG. 4. Again, the stringer preferably comprises a tubular piece of aluminum having a generally rectangular cross sectional shape. Various other materials (PVC, plastics, etc.) and cross sectional shapes may also be utilized. Stringer 32 includes an interior chamber 50. A pair of ribs 52 are formed in the floor of chamber 50 and a similar pair of ribs 54 extend downwardly from the roof of the chamber. These ribs define a pair of side compartments 56 proximate the side walls 58 and 60, respectively, of stringer 32. The side walls themselves are generally flat, as is also shown in FIG. 2. A longitudinal channel 38 is formed in the upper surface of each stringer 32. Longitudinal channel 38 includes an opposing pair of inwardly facing detents 67 and 69. The channel holds a mounting bar 62 and a series of plank retaining clips 40 in a manner that will be described more fully below.

Figure 5:
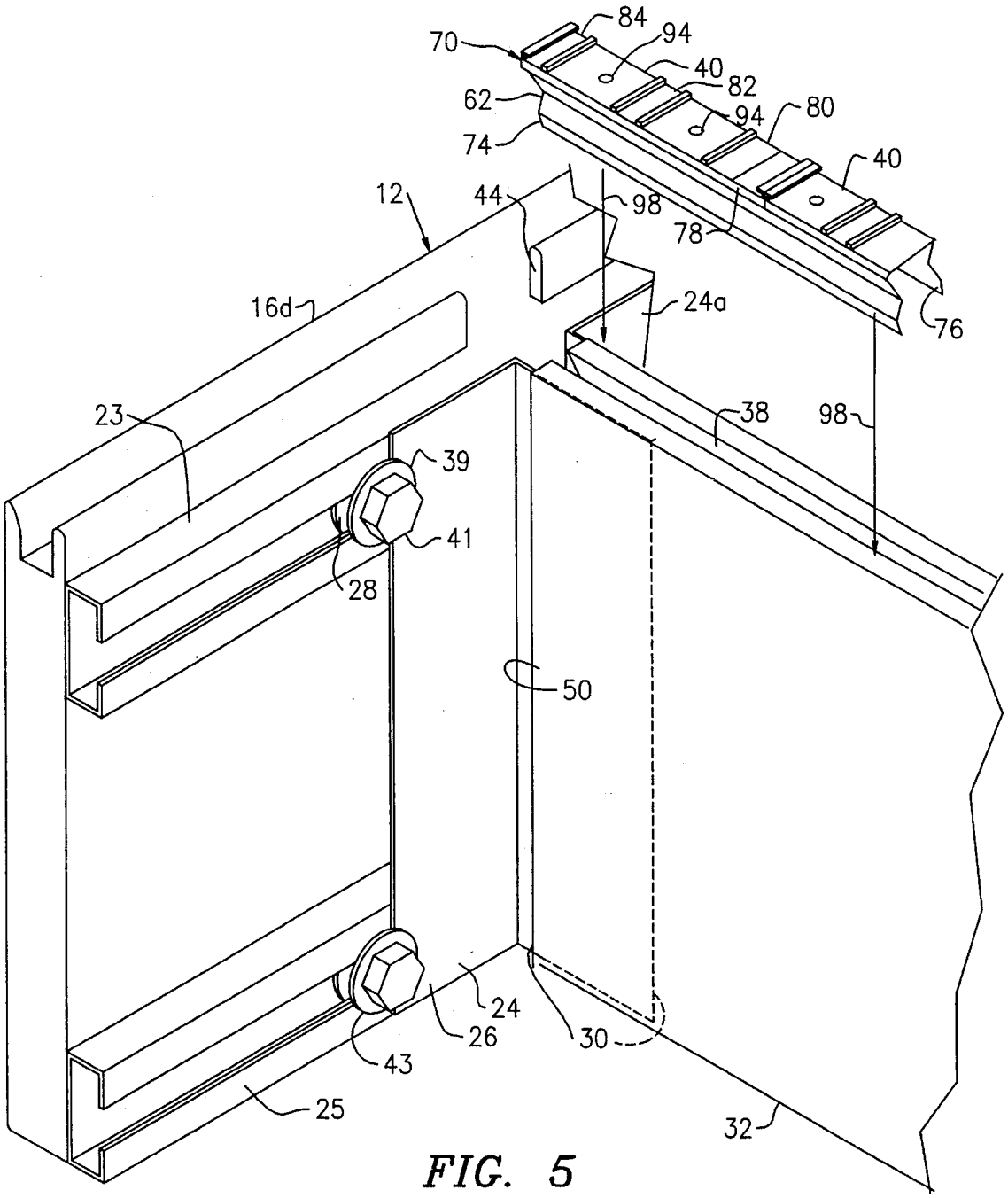
FIG. 5 is a perspective view of a stringer mounted to a peripheral joist member, as well as a clip mounting bar positioned for insertion into a longitudinal channel of the stringer.
Figure 6:
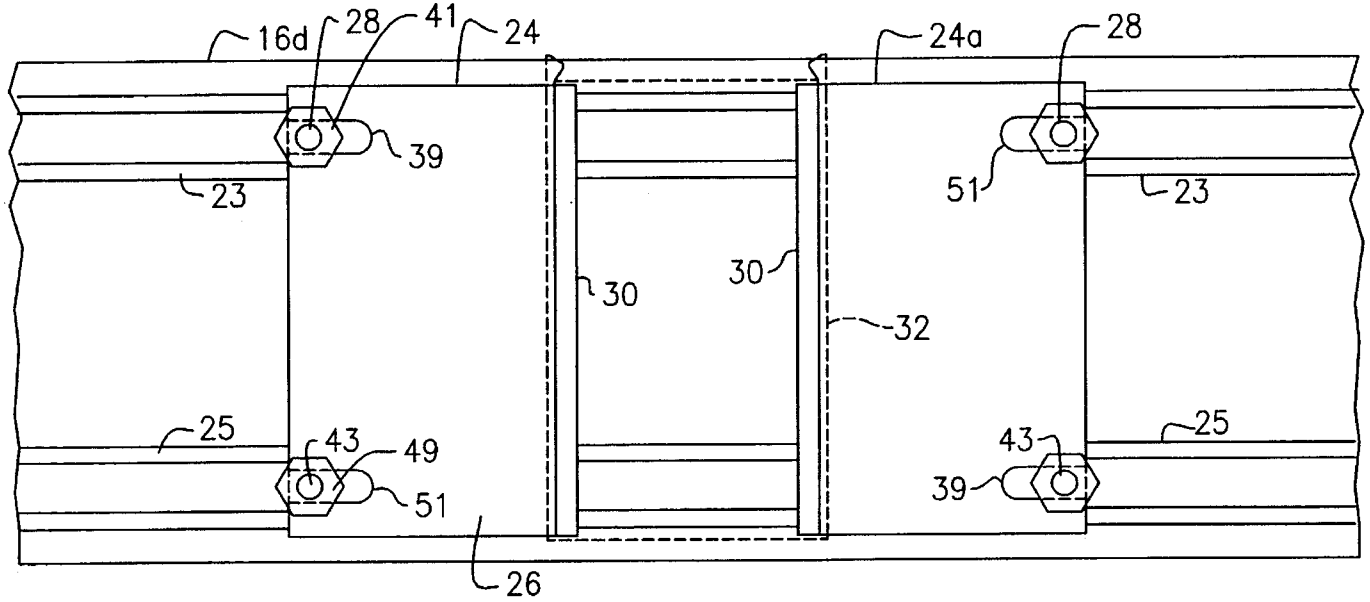
FIG. 6 is an elevational front view of a joist member used in the frame of this invention and a pair of 90° mounting brackets that are attached to the joist.

Each stringer 32 is attached at each of its ends to a respective joist member in the manner illustrated in FIG. 5. Therein, stringer 32 is secured to joist member 16*d*. The opposite end of stringer 32, which is not shown, is similarly attached to parallel joist member 16*b*. (See also FIG. 2.) In particular, referring to FIGS. 5 and 6, a pair of brackets 24 and 24*a* are mounted to joist member 16*d* in the manner previously described. An upper primary connector bolt 28 retained by slot 23 is secured to leg 26 of bracket 24 by a nut 41. Bolt 28 is received through an elongate opening 39 that extends inwardly from the edge of leg 26, as best shown in FIG. 6. Similarly, lower bolt 43 is retained in lower joist slot 25 and extends outwardly to engage an elongate opening 51 proximate the lower end of bracket leg 26. Nut 49 is secured to bolt 43 so that the bracket 24 remains attached to bolt 43.

Complementary bracket 24*a* is attached to upper and lower slots 23 and 25 in an analogous manner. As best shown in FIG. 6, bracket 24*a* is constructed identically to bracket 24 and is simply inverted and mounted to joist member 16*d* such that opening 51 is engaged by upper bolt 28 and opening 39 is engaged by lower bolt 43. Second legs 30 of respective brackets 24 and 24*a* extend outwardly from joist member 16*d* and parallel to one another, as best shown in FIG. 6.

Bracket legs 30, FIGS. 5 and 6, are inserted into the hollow interior chamber 50 (see FIG. 4) of stringer 32. The stringer is shown only in phantom in FIG. 6. More specifically, each bracket leg 30 is received in a respective narrow compartment 56 (again refer to FIG. 4) within the interior chamber 50 of stringer 32. As best shown in FIG. 5, one end of the stringer 32 butts closely against the inwardly facing surface of joist member 16*d*. As a result, the stringer is mounted securely to the joist member 16*d* by mounting brackets 24 and 24*a*. The opposite end of stringer 32 is similarly mounted to joist member 16*b*, FIG. 2.

As shown in FIGS. 2, 4 and 5, a plank retaining clip and mounting bar assembly 70 is snap fit into longitudinal upper channel 38 of each stringer 32. Assemblies 70 may also be received in the longitudinal channel 20 formed along the top surface of joist members 16*a* and 16*c*. This is illustrated in FIGS. 2 and 3. Mounting bar 62 is designed to accommodate a number of retaining clips 40 side by side such that a row of such clips may be mounted at one time to a respective stringer and/or one of the joist members 16*a* and 16*c*. Note that, in FIG. 2, retaining clips 40 are omitted from the revealed sections of joist members 16*a* and 16*c* for purposes of clarity.

Figure 7:
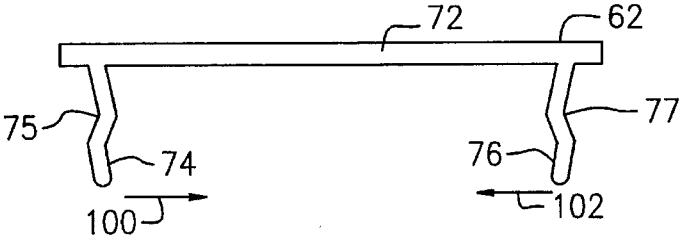
FIG. 7 is an elevational end view of the mounting bar.

Mounting bar 62, shown alone in FIG. 7, includes a generally flat base 72 and a pair of resilient flanges 74 that depend from base 76 proximate respective longitudinal edges thereof. Flanges 74 and 76 include respective indents 75 and 77. Bar 62 can feature any desired length. Typically, the bar is selected so that it has a length that is slightly greater than that of the corresponding stringer channel 38 or the corresponding joist channel 20 in which the bar is received. Bar 62 preferably comprises an extruded piece of aluminum or another metal or synthetic substance.

Figure 8:
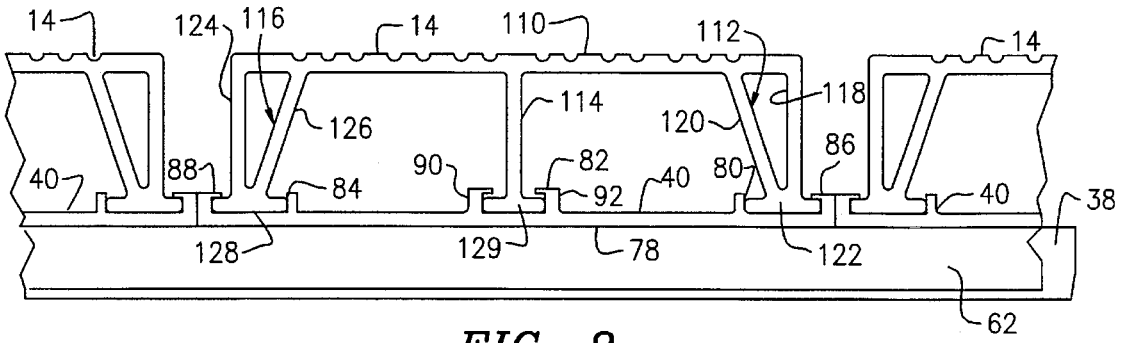
FIG. 8 is an elevational, partly cut away, front view of the stringer, the mounting bar, the retaining clip and a plank attached to the retaining clip.

A plurality of plank retaining clips 40 are mounted to the upper surface of bar 62 in the manner illustrated in FIG. 5. Clips 40 are standard items of the type disclosed in U.S. Pat. No. 5,048,448. As best shown in FIGS. 5 and 8, each clip 40 includes a generally flat clip base 78 having three clip restraining portions 80, 82 and 84. The clip elements are again preferably extruded aluminum pieces and the plank restraining portions 80, 82 and 84 typically comprise ribs that are formed on the upper surface of base 78. As best illustrated in FIG. 8, outer retaining portions 80 and 84 include respective cantilevered ribs 86 and 88 that are formed along the respective sides of clip 40. Central retaining portion 82 includes a pair of inwardly cantilevered ribs 90 and 92.

A plurality of clips 40 are arranged side by side along the base 72 of bar 62. The clips are permanently secured to bar 62 such as by rivets 94, FIG. 5. Various other means such as a toggle lock construction, adhesives and screws may be used to permanently fasten the retaining clips 40 to mounting bar 62.

Each assembly 70 is constructed so that its length is greater than the length of the stringer or joist in which it is mounted. As shown in FIGS. 1 and 5, the joist members **16*b* and 16*d* are provided with a plurality of recess notches or recesses 44 that are aligned with respective longitudinal channels 38 of stringers 32. Each recess 44 communicably interconnects the channel 38 of a respective stringer 32 with the joist channel 20. Assembly 70 is secured to frame 12 by aligning the bar 62 with the longitudinal channel 38 and aligned recess 44. Assembly 70 is then pressed downwardly in the direction of arrows 98, FIG. 5. Flanges 74 and 76 flex inwardly, as indicated by arrows 100 and 102 in FIG. 7 and snap into channel 38 such that detents 67 and 69 are received in indents 75 and 77 of legs 74 and 76, respectively. As a result, mounting bar 62 and attached retaining clips 40 are locked into channel 38 in the manner illustrated in FIGS. 2, 4, and 8. Assembly 70 extends through the recesses 44 (FIGS. 2 and 5) in the joist members 16*b* and 16*d* that are aligned with channel 38. As a result, the clip 40 at each end of the series of clips extends transversely across the channel 20 in a respective one of the joist members 16*b* (see FIG. 2) and 16*d***.

Additional assemblies 70 are secured in a similar manner to channels 20 of joist members **16*a* and 16*c*. As best illustrated in FIG. 3, longitudinal channel 20 includes a pair of detents 104 and 106 that lockably engage the indents 75 and 77 in flanges 74 and 76**, respectively.

It is important when constructing the mounting bar 62 and attached clip elements 40 to make sure that each series of clip elements is properly aligned with all other series of clips on stringers 32 and joist members **16*a* and 16*c*. Such alignment permits the planks 14 to be properly attached to and retained by the deck frame 12. A preferred manner of attachment is illustrated in FIG. 8. Plank 14 comprises an extruded plastic member having an upper web 110 and a plurality of depending flange supporting sections 112, 114, and 116. Flange supporting section 112 includes a vertical leg 118 and an angled leg 120 that converges with leg 118 and carries a retaining flange 122. Similarly, flange supporting portion 116 includes a vertical leg 124 and an angled leg 126 that converges with leg 124 and carries a second outer flange 128. Central support 114 comprises a single leg that carries a central flange 129. After each mounting bar 62 and its attached clip elements 40 are secured to their respective stringers 32 and joist members 16*a* and 16*c*, the planks 14 are attached to the retaining clips. Flange 122 is engaged with retaining portion 80, flange 129 is engaged with retaining portion 82 and flange portion 128 is engaged with retaining portion 84. More particularly, each flange portion is snap fit into a respective retaining portion. The respective cantilevered ribs hold the flange portions in place. If each assembly 70** is properly aligned in the above described manner, installation should be quick and easy.

The process of inserting the planks into the respective aligned clip elements 40 is further described in U.S. Pat. No. 5,048,448. Each adjoining plank 14 is secured to a respective series of aligned clips in a similar manner to complete construction of the deck. When installed, each plank extends transversely across joist members 16 and **16*c* and across the intermediate stringers. At the same time, the planks are parallel to the joist members 16*b* and 16*d***. Of course, this arrangement will vary somewhat depending upon the configuration of the deck assembly. In any event, the plank members extend transversely across at least some stringers and/or joist members and are secured thereto in the manner described in this invention.

Figure 9:
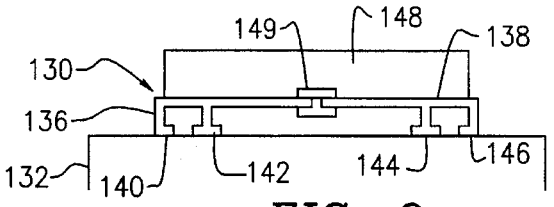
FIG. 9 is an elevational, end view of an alternative mounting bar secured to a wooden frame element.
Figure 10:
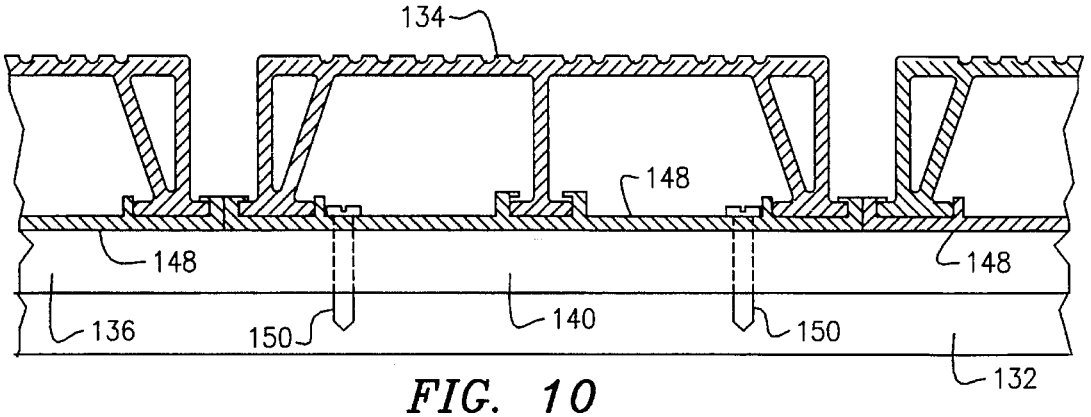
FIG. 10 is a cross sectional view of the alternative mounting bar and retaining clip of FIG. 9, as well as an associated plank element.

An alternative clip and mounting bar assembly 130, according to this invention, is illustrated in FIGS. 9 and 10. In this embodiment, the deck employs a frame element 132 composed of wood. Frame element 132 may be a joist member, a stringer or some other structural piece used to support extruded plastic planks 134, FIG. 10. Planks 134 resemble or are identical to the planks of the previously described embodiment. Assembly 130 includes an elongate mounting bar 136. This bar 136 includes a generally flat platform portion 138 and a plurality of supporting legs 140, 142, 144 and 146. These legs engage the upper surface of frame element 132 and extend longitudinally for most if not all of the length of the frame element.

A series of plank retaining clips 148 are mounted side by side on upper platform surface 138 of bar 136. A rivet or toggle lock 149, FIG. 9, permanently secures each of the clips to the mounting bar. A pair of screws 150 secure the entire bar to the underlying frame 132. Screws 150 are depicted as extending through the same clip. However, in practice only two such clips are typically required to retain a mounting bar 136 holding ten or more side by side clips 148. Each of the clips is itself interconnected to the bar by the above-described rivet 149 or alternative means.

As in the previously described embodiment, the embodiment of FIG. 9 and 10 permits an entire row of deck retaining clips to be mounted simultaneously to the deck frame 132 in a simple and convenient manner. Each clip does not require independent installation, as is required in the prior art.

Figure 11:
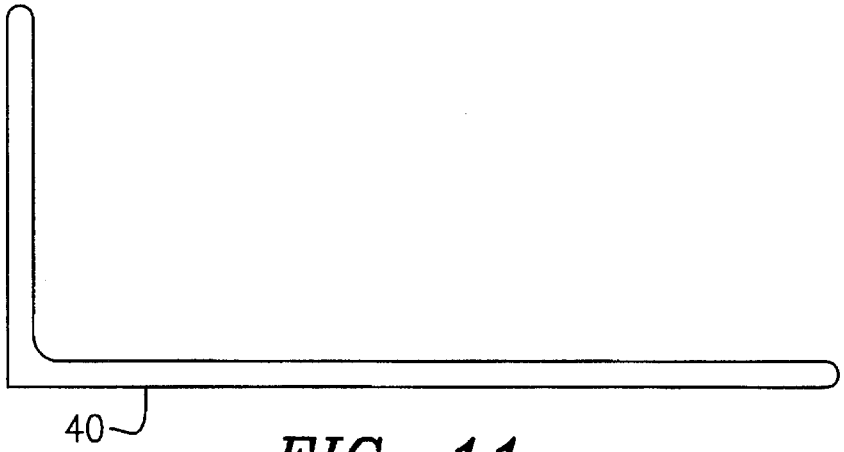
FIG. 11 is top view of a 90° mounting bracket.
Figure 12:
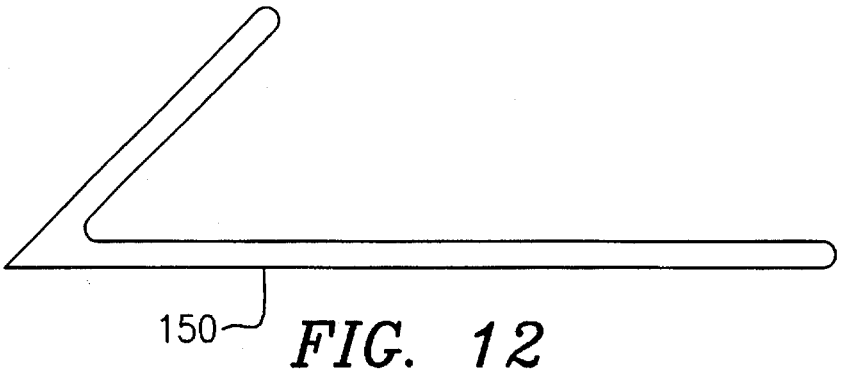
FIG. 12 is a top view of a 45° mounting bracket.
Figure 13:
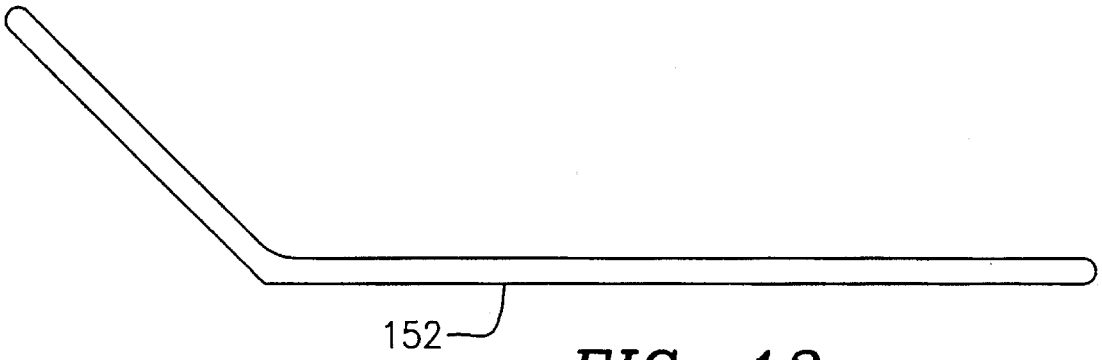
FIG. 13 is a top view of a 135° mounting bracket.

FIGS. 11–13 depict various configurations that may be employed by the mounting bracket. FIG. 11 depicts the 90° mounting bracket 24 that was employed in the embodiment of FIGS. 1–8. The stringers and/or joist members may also be joined at 45° angles by using the mounting bracket 150 shown in FIG. 12. Alternatively, the adjoining structural elements may be interconnected at an angle of 135° by utilizing the mounting bracket 152 shown in FIG. 13.

Each of the mounting brackets may be used for a variety of purposes. For example, a pair of adjoining brackets 24, **24*a* may be utilized to mount the frame 12 to a support post 22, as illustrated in FIG. 2. A similarly supported pair of adjoining brackets may be employed to mount one or more stringers to a peripheral frame shown in the above-described embodiment. The mounting brackets may also be used to reinforce the interconnection between adjoining joist members. For example, a pair of the mounting brackets shown in FIGS. 11, 12, and 13, respectively, may be inserted at the junction between two adjoining joist members. Each leg of each such mounting bracket is received in a respective interior joist channel, such as interior channels 33 and 133, shown in FIG. 3**. The brackets therefore serve not only as mounting elements but also to reinforce the interconnected joist members.

The deck mounting assembly of this invention therefore provides for a number of advantages. This construction significantly reduces the amount of wood employed in the deck and therefore increases deck life and reduces the necessity for frequent and expensive deck repairs. Mass produced, modular pieces are employed so that the deck may be put together quickly and conveniently. At the same time, an almost endless variety of custom design configurations may be achieved. The material is light weight and easy to work with. The assembly of decks, docks and similar systems is facilitated considerably.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A system for assembling for a deck structure comprising:

a peripheral frame that includes a plurality of elongate, interconnected joist members, each said member having means defining at least one inwardly facing longitudinal slot, each said slot having an interior portion and an entrance that is narrower than said interior portion;

at least one elongate stringer that extends between a pair of said joist members, each said stringer including a pair of receptacles formed in respective ends thereof;

means for interconnecting each end of each said stringer to a respective joist member, including at least one mounting bracket, each said bracket having a first leg that engages said respective joist member and a second leg that is attached angularly to and extends from said first leg and is received by said receptacle in said end of said stringer, and means for connecting each said bracket to said respective joist member, said means for connecting including at least one primary connector element, each said primary connector element being retained by and extending from said slot and engaging a corresponding opening in said first leg of said bracket and at least one secondary connector element, each said secondary connector element being engaged with a respective said primary element to restrict said bracket from disengaging said first connector element, whereby each said stringer is mounted to a pair of joist members.

2. The assembly of claim 1 in which each said joist member includes a pair of parallel slots.

3. The assembly of claim 2 in which said means for connecting include a pair of primary connector elements, each of which is associated with a respective one of said slots.

4. The assembly of claim 3 in which said means for connecting include a pair of secondary connectors, each being engaged with a respective one of said primary connector elements.

5. The assembly of claim 1 in which said means for interconnecting include a pair of said mounting brackets, said second legs comprising respective planar elements that extend generally parallel to one another.

6. The assembly of claim 5 in which each said receptacle in said stringer includes a pair of separated compartments, each said compartment receiving a second leg of a respective one of said pair of mounting brackets.

7. The assembly of claim 1 in which each said inside stringer includes a longitudinal channel, said assembly further including an elongate mounting bar that is received in said channel, said channel and said bar including complementary means for securely retaining said bar in said channel, and a plurality of plank retaining clip elements mounted to said bar and arranged generally side by side thereon, each said clip element having means for retaining a respective deck plank such that said plank extends transversely across said stringer.

8. The assembly of claim 1 in which at least one of said joist members includes at least one interior channel for selectively accommodating a respective reinforcing element.

9. The assembly of claim 7 in which said complementary means include a pair of detents carried respectively on a first side and an opposite second side of said channel and a pair of resilient flanges depending, from an upper portion of said bar, each said flange including an indented portion that receives a respective one of said detents when said flanges are introduced into said channel to securely retain bar in said channel.

10. The assembly of claim 1 in which at least one of said joist members includes a longitudinal upper channel, said assembly further including an elongate mounting bar that is received in said channel, said channel and said bar including complementary means for securely retaining said bar in said channel, and a plurality of plank retaining clip elements mounted to said bar and arranged generally side by side thereon, each said clip element having means for retaining a respective deck plank such that said plank extends transversely across said joist.

11. The assembly of claim 10 in which at least one of said pair of joist members has a longitudinal upper joist channel and a recess that interconnects said longitudinal upper joist channel with said longitudinal channel in a said stringer that is interconnected to said joist member and in which said mounting bar received in said longitudinal stringer channel extends through said recess and transversely through said upper joist channel.

12. A system for assembling a deck structure, said system comprising:

an elongate joist member having at least one inwardly facing slot formed therein, each said slot having an interior portion and an entrance that is narrower than said interior portion;

a mounting bracket having a first leg that engages said joist member and a second leg that is attached to and extends at an angle from said first leg for engaging a section of the deck structure; and means for connecting said bracket to said joist member, including at least one primary connector element, each said primary connector element being retained by and extending from a respective said slot and engaging a corresponding opening in said first leg of said bracket, and at least one secondary connector element, each said secondary connector element being engaged with a corresponding primary connector element to restrict said bracket from disengaging said corresponding primary connector element.

13. The assembly of claim 12 in which said joist member includes a pair of said slots arranged parallel to one another.

14. The assembly of claim 13 in which said means for connecting include a pair of primary connector elements, each of which is associated with a respective one of said slots.

15. The assembly of claim 14 in which said means for connecting include a pair of secondary connectors, each being engaged with a respective one of said primary connector elements.

16. The assembly of claim 12 in which each said primary connector element includes a bolt element having a head received in a respective said slot and a threaded shaft that engages said corresponding opening, each said secondary connector element including a nut element that threadably engages the shaft of a respective said primary connector element.

17. The assembly of claim 12 in which said joist member includes at least one interior channel for accommodating a respective reinforcing element.

18. A system mounting a plurality of standard deck planks, which planks comprise an upper horizontal surface and three flange sections that depend from the horizontal surface, said system comprising:

a plurality of elongate joist members that are arranged parallel to one another;

a like plurality of elongate mounting bars that are separate and distinct from said joist members, each said bar including a substantially planar portion that is disposed above and substantially parallel to an upwardly facing surface of a respective joist member;

means for releasably attaching each said bar to said respective joist member; and means defining a plurality of plank retaining clip elements connected to and supported by each said mounting bar and arranged generally side by side along said bar, each said clip element including means for interengaging and retaining the depending flange sections of a respective standard deck plank such that the plank extends transversely across said mounting bars and said joist members.

19. The system of claim 18 in which each joist member includes an elongate channel that receives an associated one of said mounting bars, said channel and said associated bar including complementary means for securely retaining said bar in said channel.

20. The assembly of claim 19 in which said complementary means include a pair of detents carried respectively on a first side and an opposite second side of said channel and a pair of resilient flanges depending from an upper portion of said bar, each said flange including an indented portion that receives a respective one of said detents when said flanges are introduced into said channel to securely retain bar in said channel.

* * * * *